United States Patent [19]

Slonimsky et al.

[11] Patent Number: 4,811,927

[45] Date of Patent: Mar. 14, 1989

[54] TUBULAR CONNECTING MEMBER FOR USE WITH CONCRETE FORMING PANELS

[75] Inventors: Leonid Slonimsky, Toronto; Dan D. Dorcich, Georgetown, both of Canada

[73] Assignee: 589576 Ontario Inc., Mississauga, Canada

[21] Appl. No.: 135,234

[22] Filed: Dec. 21, 1987

Related U.S. Application Data

[62] Division of Ser. No. 7,501, Jan. 28, 1987.

[30] Foreign Application Priority Data

Jan. 31, 1986 [CA] Canada ..... 500825

[51] Int. Cl.[4] ..... E04G 17/00

[52] U.S. Cl. ..... 249/210; 52/738; 249/45; 249/47; 249/191; 249/192; 249/219.1

[58] Field of Search ..... 249/33, 40, 44, 45, 249/47, 189, 190, 191, 192, 193, 207, 210, 213, 219.1; 52/27, 36, 282, 335, 721, 731, 733, 738

[56] References Cited

U.S. PATENT DOCUMENTS 2,939,198 6/1960 Nicholls ..... 249/194
4,453,363 6/1984 Koller ..... 52/731

*Primary Examiner*—Jay H. Woo
*Assistant Examiner*—James C. Housel
*Attorney, Agent, or Firm*—Wegner & Bretschneider

[57] ABSTRACT

A panel connecting member for use with tie rods and panels for a concrete forming structure, which panels each have bolt holding structures along the edges thereof. This member is tubular and has two connecting flanges extending outwardly from one side. Slots to receive bolts are cut in the edges of these flanges. First and second aligned holes are provided in opposite sides of the tubular member for passage of a tie rod. Channel-forming, longitudinally extending projections are provided on the side of the tubular member opposite said one side. These projections are adapted to receive between them flanges provided on the edges of the panels. The preferred panel has a corrugated, aluminum core member substantially covering an interior space of the panel defined by two siderails and two end rails. Inner and outer structural sheets extend between these two sets of rails and are both connected to said core member.

7 Claims, 5 Drawing Sheets

TUBULAR CONNECTING MEMBER FOR USE WITH CONCRETE FORMING PANELS

This application is a division of applicants' co-pending U.S. patent application Ser. No. 007,501 filed Jan. 28, 1987.

BACKGROUND OF THE INVENTION

This invention relates to connecting members for modular panels for a concrete forming structure.

In the past, the cost of the formwork needed to erect a poured concrete structure has averaged approximately 50% of the total cost of the concrete structure and one reason for this substantial cost is that the erection of the formwork is labour intensive. Because the cost of labour is high, there is a need for better, more efficient forming systems in order to increase productivity and to reduce the amount of time required to erect formwork. Various attempts have been made in the past to provide a modular forming system that is relatively easy to erect and that is not prohibitively expensive to produce.

Some of the modular panels for concrete formwork in the past have a sheet of plywood or metal that faces the concrete to be poured, which sheet is supported by transverse metal bars or frame members attached to a generally rectangular frame that extends around the perimeter of the panel. Various devices are provided for connecting such panels in a rigid edge-to-edge relationship to create the formwork. One difficulty with these known panels is that they tend to be quite heavy due to the fact that the plywood thickness for such a panel is from ⅝" to 11/16" and the transverse and peripheral frame members can also have a substantial weight, whether made from wood or metal.

It will be appreciated that the ideal modular panel for a concrete forming system should have the greatest possible strength to weight ratio. The panel must have sufficient strength to resist the pressure of the fresh concrete and to prevent bulges in the concrete and they should also be sufficiently strong to withstand the rough handling that they may receive on a construction site. In addition, because these panels are repeatedly assembled, then disassembled, and then moved from one construction site to another for reuse, the smaller the weight of each panel the easier it is to work with. If the weight of the panel is kept to less then 100 pounds, it may be possible to handle and transport the panel by manual labour. Large panels and panels having a weight of 100 pounds or more may necessitate the use of a crane for handling and transport.

Another difficulty with known panels for formwork is that they are either not suitable for or are costly to use in cold climatic conditions. If no provision is made in the panel for keeping the inside surface of the panel warm, then either the concrete will not cure properly in cold weather, or a special costly enclosure must be created so that the area around the formwork is heated. Although attempts have been made in the past to produce modular panels for formwork that have their own heating means, such attempts have produced panels that are generally unsatisfactory or are too expensive. One difficulty with some of the known heated panels is that they do not stand up very well on a construction site. Often nails must be driven into these panels due to job requirements and such nails can damage known heating systems. Also, if a heating system is to be provided in a modular panel, there should also be insulation in the panel so that heat loss from the panel is not excessive.

U.S. Pat. No. 4,033,544 issued July 5, 1977 to Aluma Building Systems Inc. describes a wall forming structure for a poured concrete wall. Opposed panels are connected together by ties and are supported by strongbacks. Each panel comprises a planar sheathing secured to a plurality of studs that extend parallel to one another. Each strongback comprises a pair of channel-shaped members which are placed in spaced back-to-back relationship. Each of the channel-shaped members has an outwardly facing T-shaped slot for receiving the heads of attachment bolts. A plurality of connecting plates are secured to the strongbacks by these bolts. The difficulty with this known system is that it still requires a considerable amount of labour and time to assemble on a job site. This known system is also not very flexible in that it does not easily accommodate changes in the height or the length of the formwork.

U.S. Pat. No. 3,862,737 issued Jan. 18, 1975 to Hoover Ball and Bearing Company describes a flat panel having a flat surface on one side against which concrete can be poured and having on the other side a U-shaped channel frame extending around the marginal edges of the panel. The panel also has transverse brace members which are secured to the sheet forming the flat surface and at their ends to the U-shaped peripheral frame. Locking devices are inserted through aligned holes in adjacent panels to connect them together. No means are provided for heating these panels which also are not insulated.

U.S. Pat. No. 3,144,701 issued Aug. 18, 1964 to Symons Manufacturing Company describes a panel unit having a rectangular peripheral frame to one side of which is attached a flat rectangular plywood facing. A rectangular rearwardly bulged pan made of high strength sheet material covers the space inside the rectangular frame. In the space between this pan and the plywood facing is a load transferring, heat-insulating material which can be polyether urethane foam. These insulating panels are locked together in a generally conventional fashion using keys and wedges which require that the back of the panel remain open to a substantial extent. Also, the amount of insulation behind any given location on the face of the panel varies considerably. In order to counteract for the lack of insulation at the edge of the panel, this patent specification teaches that one can provide electrical resistance heaters embedded in the marginal portions of the insulation. With this system, it may be difficult for the user to provide the necessary balance between the active heat provided by the heaters and the protection from the cold provided by the passive insulation and therefore the curing of the concrete may not be uniform or adequate.

It is an object of the invention to provide a special panel connecting member that can be used in conjunction with tie rods and the panels disclosed herein. This connecting member can be made inexpensively and it is easy to use on the job site. It can come in a number of possible lengths with the length to be used depending upon the particular job application. The connector is designed for use along the edges of the panels and on the outside thereof so that the interior of the panels can be closed and completely insulated.

SUMMARY OF THE INVENTION

According to the invention, a panel connecting member for use with tie rods and panels for a concrete forming structure is provided. The connecting member comprises a tubular member having two connecting flanges extending outwardly from one side of the member. Bolt receiving means are formed in each of the flanges. These receiving means are located to receive bolts whose heads are held in bolt holding structures formed along the edges of the afore-mentioned panels which are to be connected. There is a first hole in the one side of the tubular member for passage of one end of a tie rod and a second hole in the side of the tubular member opposite said one side for passage of the tie rod. The second hole is aligned with the first hole. Channel-forming, longitudinally extending projections on the aforementioned opposite side of the tubular member are adapted to receive between them flanges provided on the edges of the panels.

In the preferred connecting member there is a tubular section having relatively thin walls and a substantially rectangular cross-section and a relatively thick, flat plate member rigidly attached to one side of the tubular section, opposite ends of which form the connecting flanges.

Further features and advantages will become apparent from the following detailed description of preferred embodiments when considered in conjunction with the accompanying drawings.

DETAILED DESCRIPTION OF PREFERRED EMBODIMENT

Figure 1:
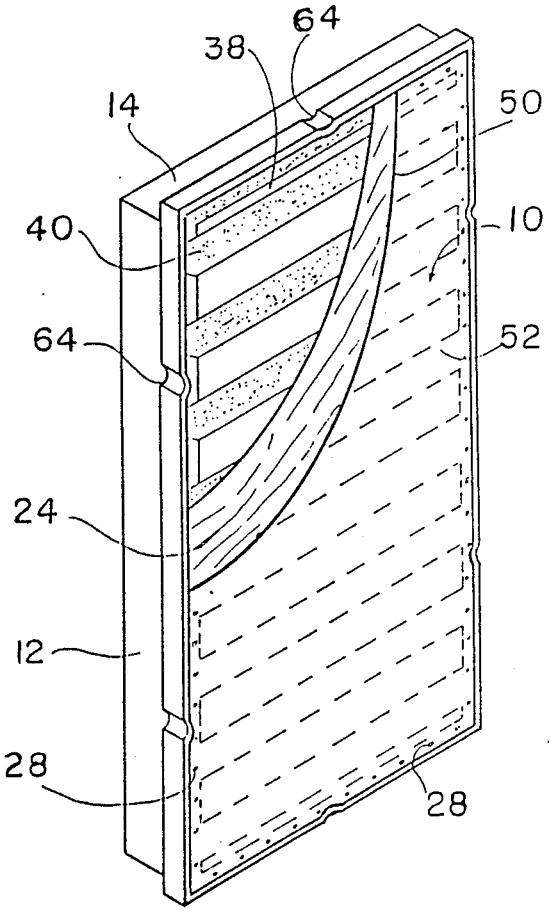
FIG. 1 is a perspective view of an insulated panel, partially cut-away, which panel can be used with the connecting member of the invention.
Figure 2:
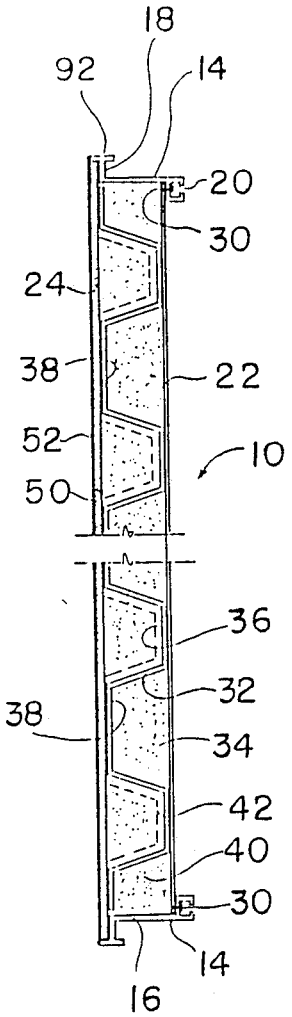
FIG. 2 is a longitudinal cross-section of the panel of FIG. 1.

A panel 10 for a concrete forming structure is shown in FIGS. 1 and 2. The panel has a rectangular peripheral frame constructed with two parallel, spaced-apart siderails 12 (only one of which is shown in FIG. 1) and two parallel end rails 14 extending between and connecting the respective ends of the siderails. The siderails 12 extend the length of the panel which, in the preferred embodiment shown, is twice as long as it is wide. Preferably, the cross-section of the siderails is the same as that of the end rails whose cross-section is shown in FIG. 2. In particular, each rail has an intermediate web section 16, an outwardly extending flange section 18 and a bolt slot structure 20, the purpose of which is described further hereinafter.

Figure 7:
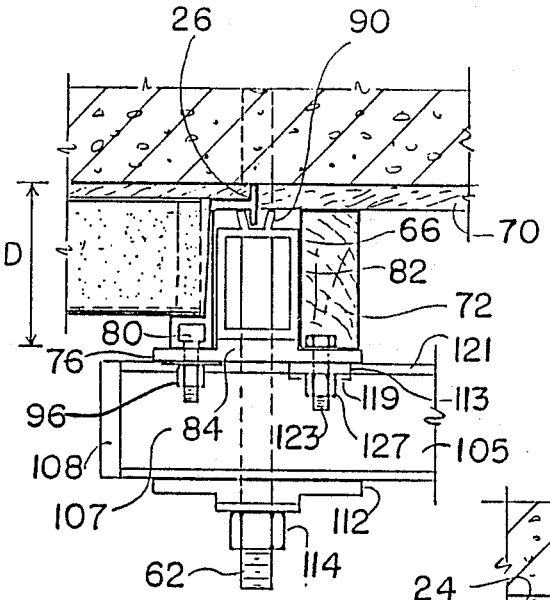
FIG. 7 is a sectional view showing use of the panel connecting member, which view is taken along the line VII—VII of FIG. 3.
Figure 8:
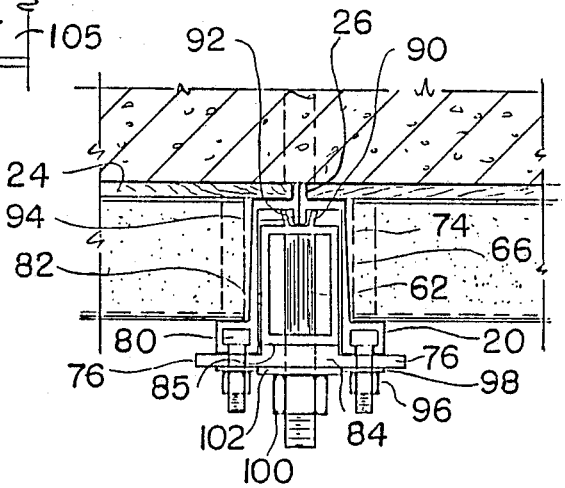
FIG. 8 is a sectional detail showing use of a connecting member between two panels, this view being taken along the line VIII—VIII of FIG. 3.

The panel 10 further comprises an outer structural sheet 22, preferably made of metal, extending between and attached to the siderails 12 and extending between and attached to the end rails 14. Most preferably, this structural sheet is made of aluminum and is a structural sheet in that it contributes to the overall strength and stiffness of the panel. The panel also has an inner sheet 24 suitable for facing the concrete to be poured and extending between and attached to the siderails and extending between and attached to the end rails. The preferred material for the inner sheet 24 is plywood. The edges of the plywood sheet are supported by and connected to the flange sections 18 of the rails. Preferably, as indicated in FIGS. 7 and 8, there is a lip 26 formed on the outer extremity of the flange section and extending along the edge of the plywood sheet 24. This lip 26 helps to protect the edge of the plywood. Preferably, the inner sheet 24 is made of high density plywood with an extra heavy overlay film which will allow many reuses of the panel. To keep the panel light, the sheet 24 has a maximum thickness of $\frac{3}{8}$ inch. This thickness is possible because the rear of the sheet is well supported as explained below. The preferred means of attachment of the plywood sheet ot the flange sections is by means of aluminum blind (pop) rivets (i.e. 4.8 mm diameter rivets) and a continuous strip of an adhesive-sealant that extends about the perimeter of the sheet. These rivets 28 are distributed along both the side edges and the ends of the panel as indicated in FIG. 1. The aformentioned outer sheet 22 is also preferably connected to the end rails and siderails by similar aluminum blind rivets located at 30 (see FIG. 2).

Located inside the rectangular frame formed by the rails and between the outer sheet 22 and the inner sheet 24 is a core means 32 for supporting the inner sheet. Preferably, the core means comprises a corrugated core member. The core means is rigidly connected to the inner and outer sheets at a number of locations spread over the length and width of the sheets. In the preferred embodiment shown in FIGS. 1 an 2, the corrugations extend transversely across the width of the panel and they form inner and outer troughs 34 having a trapezoidal cross-section. The corrugations have flat side sections 36 that are connected to the outer sheet 22 and additional flat side sections 13 that are connected to the inner plywood sheet. Preferably these parts of the panel are joined together by structural epoxy adhesive. The preferred core member 32 is made from aluminum sheet by pressing or rolling. the core member 32 provides closely spaced supporting surfaces for the plywood sheet 24. Because of this, the thickness of the plywood can be kept to the minimum required to withstand working conditions and to permit the necessary nailing. Because the plywood need not be particularly thick, the weight of the panel can be kept low for ease of transport and manipulation. It will be appreciated by one skilled in this art that other forms of core means are possible for the panel of this invention. For example, a honey comb structure made of metal sheet material could also be used but it may be more difficult to insulate then the corrugated core member shown.

Preferably the panel 10 is insulated by the of a rigid insulating material 40 that fills both the inner and outer troughs 34 formed by the core member use 32. The insulation 40 which can be either poured or premolded is preferably light weight, dimensionally stable closed cell insulation such as isocyanurate foam or polyurethane foam. It should be understood that there is no structural requirement for this insulation. Since the insulation is as light as possible, i.e. 2 lbs/cubic foot, it is not load transferring. However, in addition to its insulating properties, it also prevents moisture and vapour penetration inside the panel 10. If a non-rigid insulation were used, a perforation in the outer skins of the panel could permit water to seep into the panel which could damage it eventually.

Figure 4:
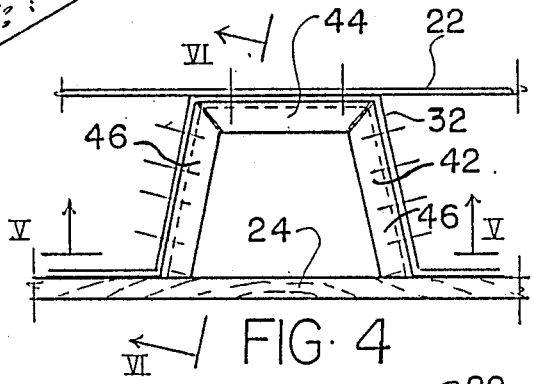
FIG. 4 is a detail view of a stiffener used in the panel of FIG. 1.
Figure 5:
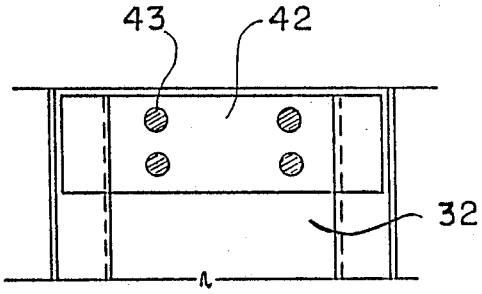
FIG. 5 is a sectional view taken along the line V—V of FIG. 4 and showing the top of the stiffener.
Figure 6:
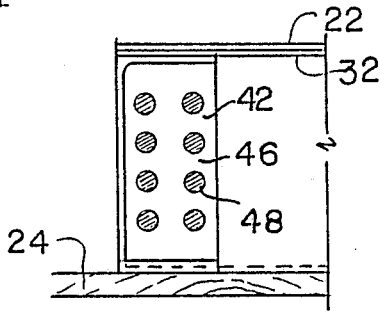
FIG. 6 is another sectional view of the stiffener taken along the line VI—VI of FIG. 4.

FIGS. 4 to 6 of the drawings illustrate stiffeners 42 that are preferably provided at the ends of the corrugations in the core member 32. These stiffeners are spot welded at 43 to the core member 32 to provide resistance to crushing where the core member is connected to and supported by the siderails 12. The stiffeners can be made from extruded aluminum by a stamping process. Each stiffener has a central connecting section 44 and two sloping outer sections 46. Each of these sections has a L-shaped cross-section with the inwardly extending leg of each section located adjacent to the adjoining siderail 12. As indicated in FIG. 6, each outer section 46 is spot welded at 48 to the adjoining sloping section of the core member. These are spot resistance welds that can be made by a three phase welding machine. Other forms of stiffeners could be provided. For example, the stiffening elements could be integrally formed on the corrugated member.

If desired, or if required, the panel 10 can be provided with an electrical heating element to heat the concrete in cold weather. Electric heating elements provide an added advantage in that they can be used to accelerate the curing of the concrete when required. For high efficiency, the heating element should be as close as possible to the concrete to be cured and should be backed by the insulating material 40. The preferred heating element of this invention is a non-metallic surface heating element 50 that extends over the entire inner surface of the panel 10. This heating element is bonded by a suitable adhesive to the surface of the plywood sheet 24. The heating element 50 is covered by a high density, reinforced plastic overlay 52. The preferred heating element which per se is known is of such a nature that it can be nailed or punctured without damage thereto. The heating element can be that sold by Thermofilm Corporation under the trade mark THERMOFILM. It is made from a mixture of graphite and carbon utilizing polytetrafluorethylene as a binder. This mixture is sintered into special glass fiber cloth. This element is bonded between layers of a high-dielectric polyester film and copper contact tapes are applied along each edge of the cloth strip for application of the voltage.

Figure 3:
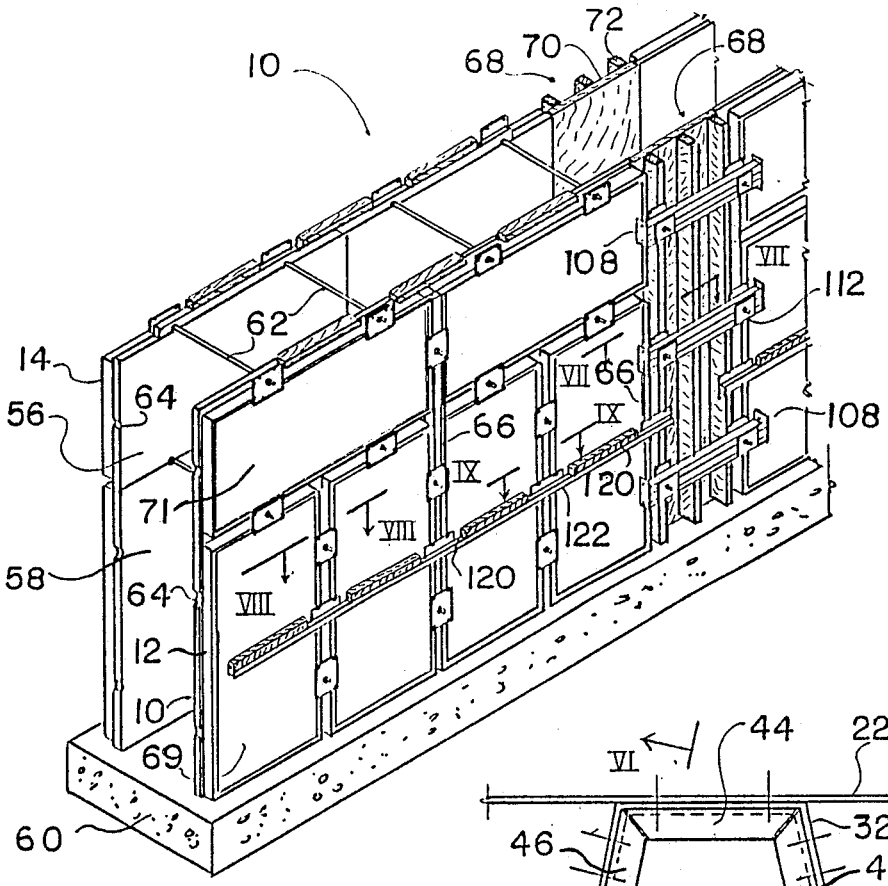
FIG. 3 is a perspective view showing formwork constructed with the above panels and the connecting pieces of the invention.

FIG. 3 illustrates how the panels 10 of the invention can be connected together with other panels and traditional formwork to construct concrete forming walls 56 and 58. These walls can be erected on a standard concrete base or footing 60 and are joined together by standard steel tie rods 62. The ends of the tie rods pass through suitable openings provided where the panels are joined together. These openings are formed by semi-cylindrical recesses 64. In the illustrated embodiment, there is one such recess 64 in the middle of the end rail of each panel and two such recesses along each siderail 12. The ends of the tie rods are connected to panel connecting members 66 which are described further hereinafter. Because the preferred length of each panel 10 is twice the width of the panel and because the sides and ends of the panels are constructed in the same fashion, the panels can be arranged either side by side as shown at 69 in FIG. 3 or end-to-end as shown at 71 in FIG. 3 or arranged in a combination. If the length of the concrete wall to be formed cannot be made by a simple combination of the standard panels in this manner, the remaining distance can readily be filled in by means of wood fillers 68. These fillers can be made with standard 11/16th" plywood 70 and 2"×4" studs or frame members 72. Where a wooden filler is used in the formwork, it is still possible to use a panel connecting member 66 constructed in accordance with the invention as shown in FIG. 7.

Figure 10:
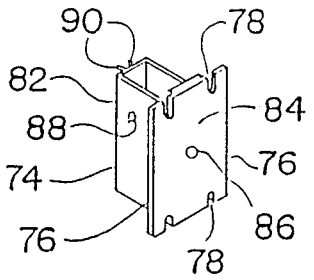
FIG. 10 is a perspective view of a short panel connector constructed in accordance with the invention.
Figure 11:
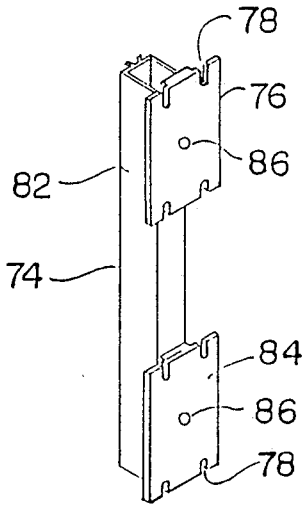
FIG. 11 is a perspective view showing a longer panel connector.

The panel connecting member 66 will now be described in detail with reference to FIGS. 8, 10 and 11. The member 66, which can vary in length as indicated by FIGS. 10 and 11, comprises a tubular member 74 having two connecting flanges 76 extending outwardly from one side of the member. Bolt receiving means are formed in each of the flanges 76 and these are located to receive bolts whose heads are held in the bolt holding structures 20 of the panels. Preferably, the bolt receiving means are in the form of slots 78 cut in the edges of the flanges and open at one end. These slots 78 have a width corresponding approximately to the diameter of the bolts 80. Preferably the tubular member 74 includes a tubular section 82 having relatively thin walls and a substantially rectangular cross-section and a relatively thick, substantially flat plate member 84 rigidly attached to one side of the tubular section. The opposite ends of the plate member 84 form the aforesaid connecting flanges 76. Preferably, a central section of the plate member is thicker than the remainder, thus forming two shoulders 85. These shoulders delineate clearly the region for attachment of the tubular section 82 and provide stops against which the adjacent rails rest at their outer edges. Preferably the plate member 84 is welded to the tubular section 82. In the short connecting member shown in FIG. 10, there is only one plate member 84, but in longer connecting members such as the one shown in FIG. 11, there can be two or more plate members 84.

To permit the connection of one or more tie rods to each connecting member 66, there are one or more holes 86 formed in the side of the tubular member that has the plate member 84 connected thereto. One or more additional holes are also provided in the opposite side of the tubular member. These holes 88, one of which is indicated in dashes in FIG. 10, are aligned with the holes 86 to permit passage of the tie rods.

Also provided on each of the connecting members 66 are channel-forming, longitudinally extending projections 90 which are on the side of the tubular member 74 opposite the thick plate member 84. The projections 90 are adapted to receive between them flanges 92 provided on the edges of the panels 10. Preferably the projections 90 have inwardly facing sides 94 that taper inwardly in the direction of the side containing the holes 86. This taper makes the insertion of the flanges 92 easier to accomplish.

When the adjacent panels 10 have been placed in position and the connecting member 66 between them is placed in the position shown in FIG. 8, the connecting bolts 80 are then firmly attached to the flanges 76 by means of nuts 96. It will be understood that the heads of the bolts 80 are first inserted into the appropriate slot structures 20 and then the bolts are slid along the slots until they pass into the slots 78. Suitable washers 98 can be placed on the projecting ends of the bolts prior to attachment of the nuts 96. It will also be understood that at one or more suitable locations along each siderail 12 or end rail 14 there can be a cut-out (not shown) that permit the head of a bolt 80 to be inserted into the slot structure 20. The projecting end of the tie rod 62 has a nut 100 threaded thereon for attachment of the rod to the connecting member 66. A washer 102 can be inserted between the nut 100 and the adjacent plate member 84.

Figure 13:
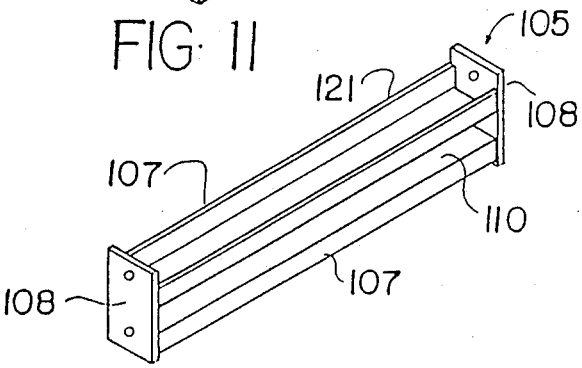
FIG. 13 is a perspective view of a water for a conventional filler.
Figure 14:
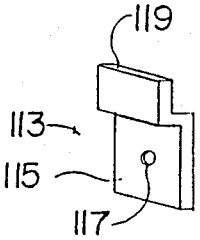
FIG. 14 is a perspective view of a clamp which can be used to attach a waler.

In the embodiment of FIG. 7, relatively short wooden frame members 72 (typically 2"×4"members) are attached to the connecting member 66 by suitable screws (not shown) and the plywood sheet 70 is nailed to the frame members 80. The members 72 are permanently attached to this particular connecting member 66. Instead of screws one could use other known wood to metal fasteners. Preferably the panels 10 of the present invention are constructed so that their total thickness indicated by the distance D in FIG. 7 equals the combined thickness of the standard 11/16" plywood 70 and the wooden standard 2"×4" members 72. As can be seen from FIG. 7, with this arrangement it is possible to use a panel connecting member 66 which is a continuous member extending the full height of the adjacent panel and which has been modified by the attachment of the frame members 72. With this construction, a waler 105 constructed in the manner shown in FIG. 13 can be used to attach the wooden formwork to the panel 10. The waler is made form two elongate channels members 107 that are spaced apart and placed back to back. Instead of the channel members 107, it is also possible to use standard 2×4 wooden frame members. The channel members 107 are connected together by end plates 108. A shown in FIG. 3, two tie rods of standard construction extend through the gap 110 formed between the channel members. A connecting plate 112 having a hole therein for the tie rod is placed against the side of the waler at each end as shown in FIG. 3. The plate 112 is held in place by a nut 114 threaded onto the tie rod. The waler is connected at each end to the connecting member 66 by means of clamps 113 the construction of which is shown in FIG. 14. Each clamp has a bolt receiving section 115 with a hole 117 and a smaller clamping section 119 which extends over a side 121 of the waler. A bolt 123 extends through the hole 117 and through the end slot 78 formed in the connecting member 66 and is held in place by nut 127.

Figure 9:
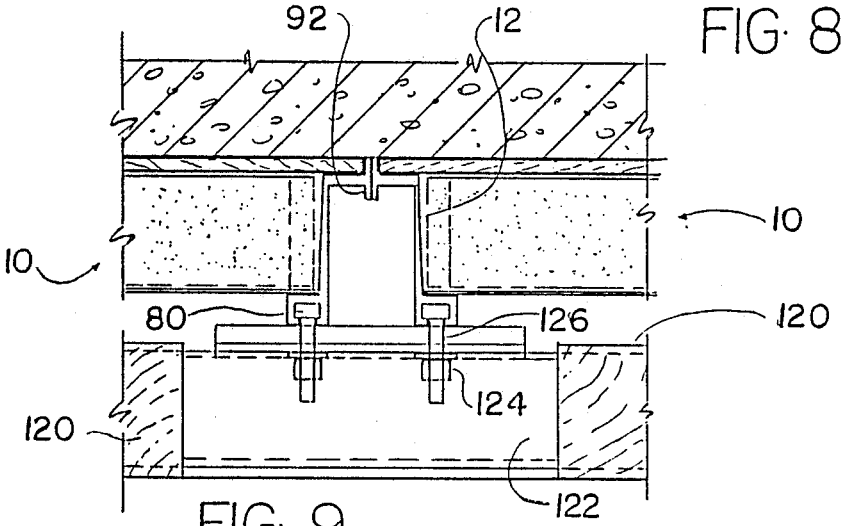
FIG. 9 is a sectional detail showing use of an alignment beam, which view is taken along the line IX—IX of FIG. 3.
Figure 12:
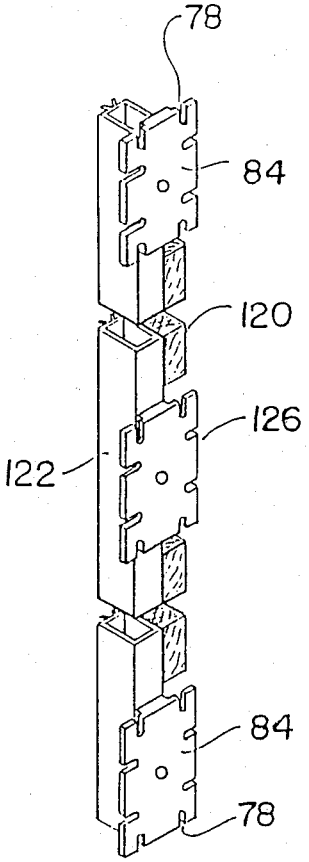
FIG. 12 is a perspective view showing a long panel connector with wooden frame members attached thereto.

FIGS. 3 and 9 illustrate how a modified panel connecting member similar to that shown in FIG. 7 can also be used as an alignment member and a stiffener. In the illustrated embodiment, the lengths of 2"×4" wooden frame members 72 are attached to a long connecting member indicated at 122. The member 122 extends across the back of several panels 10 as shown in FIG. 3. The frame members 72 do not extend across the joint region where adjacent panels are connected. The long member 122 is connected by bolts 80 and nuts 124 to the siderails 12 of the adjacent panels. The bolts 80 extend through open-ended slots 126 shown in FIG. 12. The slots 126 are formed in the edges of thick plate member 84 that are connected at spaced-apart locations along the member 122. It will be noted that with the arrangement shown in FIG. 9, it is still necessary to use connecting members 66 between the panels 10, even in the region of the long connecting member 122. The use of alignment members 122 is particularly appropriate where a number of panels are to be moved as a gang form. When a connecting member 122 is used in this manner its wooden members 72 can be used to attache 2×4 or 4×4 braces (not shown) that help support the formwork.

Figure 15:
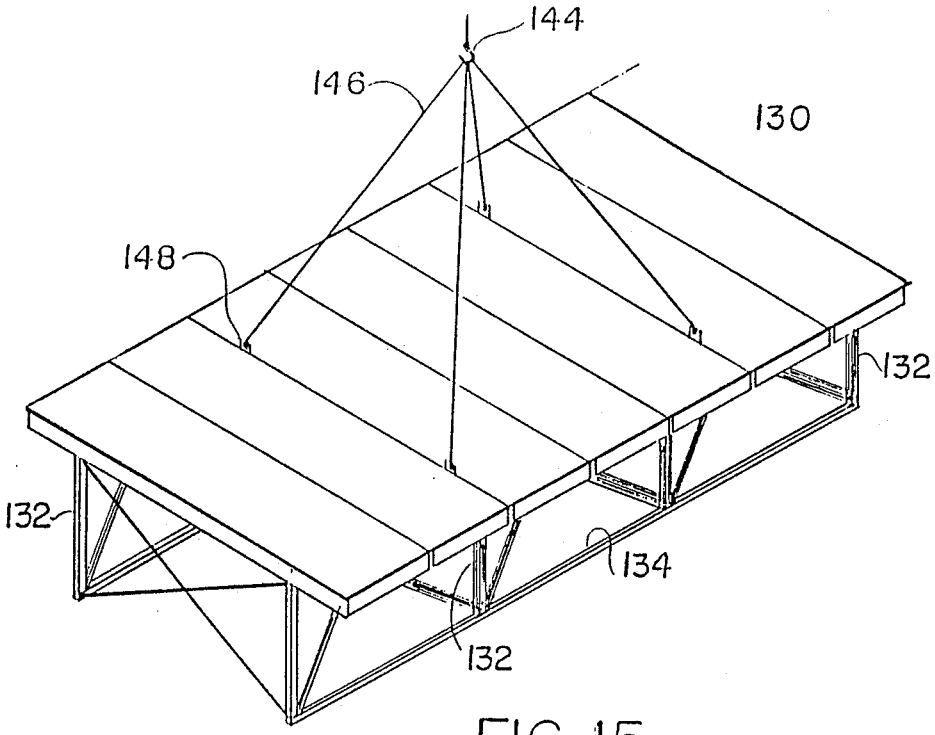
FIG. 15 is a perspective view showing use of panels to form a supporting surface that is part of a flying form.
Figure 16:
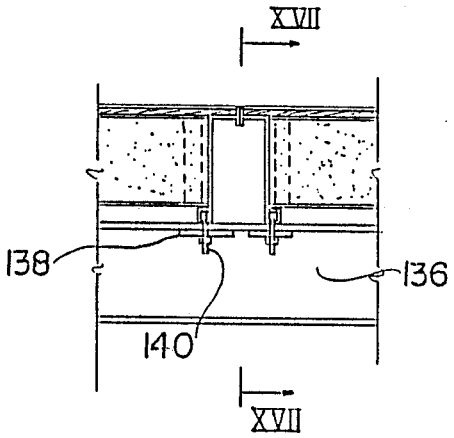
FIG. 16 is a sectional view illustrating how the panels are connected to the top chord of a truss in the flying form of FIG. 15.
Figure 17:
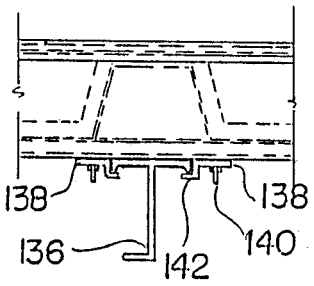
FIG. 17 is a sectional view taken along the line XVII—XVII of FIG. 16.

FIGS. 15 to 17 of the drawings illustrate how panels 130 constructed in accordance with the invention can be used as part of a "flying form". In FIG. 15 the panels 130 are larger and stronger than the standard panels 10 used for ordinary concrete formwork. The panels 130 can be made with great structural strength and rigidity by increasing their thickness. This increase in thickness produces a minimal weight increase which is quite acceptable for a flying form. The panels are also made longer so that they can bridge the long span between supporting trusses 132, the construction of which is per se known. These supporting trusses have bottom chords 134 and top chords 136, the latter being located adjcent to the bottom of the panels 130. The top chords 136 can have a T-shaped cross-section, at least in the upper region, as shown in FIG. 17. The edges of the panels 130 are fastened to the top chords by clamps 138 and bolts 140. The clamps are made from rectangular plates having a double bend therein. The inner edge 142 extends under an adjacent lip of the top chord 136. The heads of the bolts are again held in bolt slot structures formed on the siderails of the panels.

As shown in FIG. 15, the complete flying form can be moved or "flown" to its next working position by means of a crane having an attachment hook 144. The hook is attached to suitable cables 146 that are connected to lifting lugs 148, four of which are provided on the illustrated form. These lugs are attached to the top chords 136 of the trusses and are located in a suitable space between adjacent panels 130. Preferably, the lugs 148 are moveable from a retracted position wherein they do not extend above the top level of the panels 130 to the extended position shown in FIG. 15 where they can be connected to the cables.

It will be clear to one skilled in this art that various modifications and changes can be made to the illustrated preferred embodiments of the invention, if desired. The invention is not to be limited to the particular form of panel or connecting member which is specifically disclosed herein. Accordingly, all such modifications, alternative constructions and changes as fall within the scope of the appended claims are intended to be part of this invention.

We therefore claim:

1. A panel connecting member for use with tie rods and panels for a concrete forming structure, which panels each have bolt holding structures along the edges of said panels to be connected, said connecting member comprising an elongated tubular member having two connecting flanges extending outwardly in opposite directions from a first side of said member, bolt receiving means formed in each of said flanges, said receiving means being located to receive bolts whose heads are held in said bolt holding structures, a first hole in said one side of said tubular member for passage of one end of a tie rod, a second hole in a second side of said tubular member opposite said first side for passage of said tie rod, said second hole being aligned with said first hole, and channel-forming, longitudinally extending projections on the second side of said tubular member, said projections being adapted to receive between them flanges provided on the edges of said panels.

2. A panel connecting member according to claim 1 wherein said tubular member includes a tubular section having relatively thin walls and a substantially rectangular cross-section and a relatively thick plate member rigidly attached to one side of said tubular section, opposite ends of said plate member forming said connecting flanges.

3. A panel connecting member according to claim 1 wherein said bolt receiving means are in the form of slots cut in the edges of said flanges, said slots being open at one end and having a width corresponding to the diameter of said bolts.

4. A panel connecting member according to claim 2 including at least two said plate members distributed along the length of said tubular section.

5. A panel connecting member according to claim 2 having a wooden filler extending along a third side of the connecting member and connected thereto, said filler being made of frame members and one or more plywood sheets attached to said frame members.

6. A panel connecting member according to claim 5 wherein said wooden filler includes relatively short frame members connected directly to the third side of said tubular section.

7. A panel connecting member according to claim 1 wherein said channel-forming projections have inwardly facing sides that taper inwardly in the direction of said first side containing said first hole.

* * * * *